United States Patent [19]

Godec

[11] 4,437,693

[45] Mar. 20, 1984

[54] THERMALLY RESPONSIVE LATCHING DEVICE AND METHOD OF MODIFYING A LATCHING DEVICE

[75] Inventor: Maksimilijan Godec, Indianapolis, Ind.

[73] Assignee: Von Duprin, Inc., Indianapolis, Ind.

[21] Appl. No.: 263,110

[22] Filed: May 13, 1981

[51] Int. Cl.[3] ..... E05C 1/02; E05C 15/02; E05F 15/20

[52] U.S. Cl. ..... 292/191; 49/8; 292/92; 292/150; 292/DIG. 66

[58] Field of Search ..... 292/191, 192, 21, 92, 292/DIG. 66, 207, 210, 150, 106; 49/7, 8; 70/DIG. 10, 1.5

[56] References Cited

U.S. PATENT DOCUMENTS

| | | | |
|---|---|---|---|
| 554,965 | 2/1896 | Squires | 70/151 R |
| 2,772,905 | 12/1956 | Dusing | 292/DIG. 66 X |
| 3,614,145 | 10/1971 | Zawadzki | 70/92 X |
| 3,705,739 | 12/1972 | Adler | 292/DIG. 66 X |
| 3,811,717 | 5/1974 | Floyd et al. | 292/DIG. 66 X |
| 3,815,390 | 6/1974 | Stoia | 292/150 X |
| 4,006,471 | 2/1977 | Pappas | 292/92 X |
| 4,012,066 | 3/1977 | Salvatore | 292/DIG. 66 X |
| 4,015,869 | 4/1977 | Horvath | 292/DIG. 66 X |
| 4,145,900 | 3/1979 | Ohno | 292/92 X |
| 4,222,251 | 9/1980 | Uyeda | 70/1.5 |

*Primary Examiner*—Gary L. Smith
*Assistant Examiner*—R. Illich
*Attorney, Agent, or Firm*—B. J. Murphy

[57] ABSTRACT

The invention comprises a latching and unlatching device for use on a door, or bulkhead, or the like, which device has a blocking plate for internally obstructing the latch to prevent its retraction, thereby to prevent the opening of the door. The blocking plate is internally secured in place, in an intermediate slidable position, where it does not obstruct the latch, by a low melting point cover. In the presence of excessive heat, as on the occurence of fire, the cover melts; this allows the blocking plate to slide to another, operative position in which it prevents the retraction of the latch and, consequently, the unlatching of the device. The method comprises the steps to be undertaken to modify an off-the-shelf latching and unlatching device to insure that it will be held securely latched in the presence of fire or excessive heat, and the kit sets forth the structure elements required for the aforesaid modification of off-the-shelf, latching and unlatching devices.

11 Claims, 4 Drawing Figures

THERMALLY RESPONSIVE LATCHING DEVICE AND METHOD OF MODIFYING A LATCHING DEVICE

This invention pertains to latching and unlatching devices for doors and the like and, in particular, to a novel, thermally-responsive means for preventing the unlatching of the device. Accordingly, the invention has particular pertinence for fire doors as, in the presence of uncommon heat, the novel structure is thermally-responsive, as aforesaid, to insure that the doors will not unlatch. The invention further pertains to methods of modifying known latching and unlatching devices to render them unlatchable in the presence of excessive heat or fire, and to a modifying kit for the latter purpose.

In the prior art there are a number of devices, thermally-responsive for insuring that a door, designated as a fire door, will remain closed in the presence of excessive heat. However, the prior art devices are inordinately complicated, expensive of manufacture, and comprise arrangements which do not lend themselves to simple retro-fitting or modification of off-the-shelf latching and unlatching devices. What has been needed is a simple, inexpensive and facile arrangement for fixing such devices against unlatching in the presence of heat. Therefore, it is an object of this invention to set forth a simple, inexpensive and facile unlatching preventing means, for use in standard, latching and unlatching devices, a method of modifying such standard or off-the-shelf devices for the thermal-responsive feature, and a kit, useable according to the novel modifying method, to render such devices unlatchable in the presence of heat.

It is also an object of this invention to set forth thermally-responsive means for preventing unlatching of a latching and unlatching device for a door, bulkhead, latch or the like, in combination with such a device having a base, and latch means, coupled to said base and movable, relative to said base, along a pathway between a first, latching position, and a second, unlatching position, wherein said thermally-responsive means comprises: blocking means, coupled to said base, in adjacency to said latch means, for free movement thereof (a) gravitationally and obstructively into traverse of said pathway, for preventing movment of said latch means fully along said pathway, and (b) counter-gravitationally out of traverse of said pathway, for permitting movement of said latch means fully along said pathway; and retainer means, coupled to said base, (a) holding said blocking means out of traverse of said pathway and, responsive to exposure of said retainer means to a given temperature, (b) for releasing said blocking means, whereby the latter is free to move gravitationally and obstructively, as aforesaid, into traverse of said pathway.

It is another object of this invention to disclose a method of modifying a latching and unlatching device for a door, bulkhead, latch or the like, to prevent the device from being unlatchable in the presence of a given temperature, wherein such device has a base, and latch means, coupled to said base and movable, relative to said base, along a pathway between a first, latching position, and a second, unlatching position, wherein said modifying method comprises the steps of: coupling a blocking element to said base, in adjacency to said latch means, for slidable movement thereof (a) gravitationally and obstructively into traverse of said pathway, to prevent movement of said latch means fully along said pathway, and (b) counter-gravitationally out of traverse of said pathway, to permit movement of said latch means fully along said pathway; and coupling a thermally-sensitive retainer to said base, to hold said blocking element out of traverse of said pathway, which retainer is thermally-sensitive, as aforesaid, and is responsive to exposure thereof to said given temperature to release said blocking element, whereby the latter is free to slide gravitationally and obstructively, as aforesaid, into traverse of said pathway.

Finally, it is a particular object of this invention to set forth a kit for modifying a latching and unlatching device for a door, bulkhead, latch or the like, to prevent the device from being unlatchable in the presence of a given temperature, wherein such device has a base, and latch means, coupled to said base and movable, relative to said base, along a pathway between a first, latching position, and a second, unlatching position, said modifying kit comprising: a blocking element for coupling thereof to said base, in adjacency to said latch means, for slidable movement thereof (a) gravitationally and obstructively into traverse of said pathway, for preventing movement of said latch means fully along said pathway, and (b) counter-gravitationally out of traverse of said pathway, for permitting movement of said latch means fully along said pathway; and a thermally-sensitive retainer, for coupling thereof to said base, having means for holding said blocking element out of traverse of said pathway; said retainer being thermally-sensitive, as aforesaid, and comprising means responsive to an exposure thereof to said given temperature, for releasing said blocking means element, whereby the latter, upon having been coupled to said base, will be free to slide gravitationally and obstructively, as aforesaid, into traverse of said pathway.

Further objects of this invention, as well as the novel features thereof, will become more apparent by reference to the following description taken in conjunction with the accompanying figures, in which.

Figure 1:
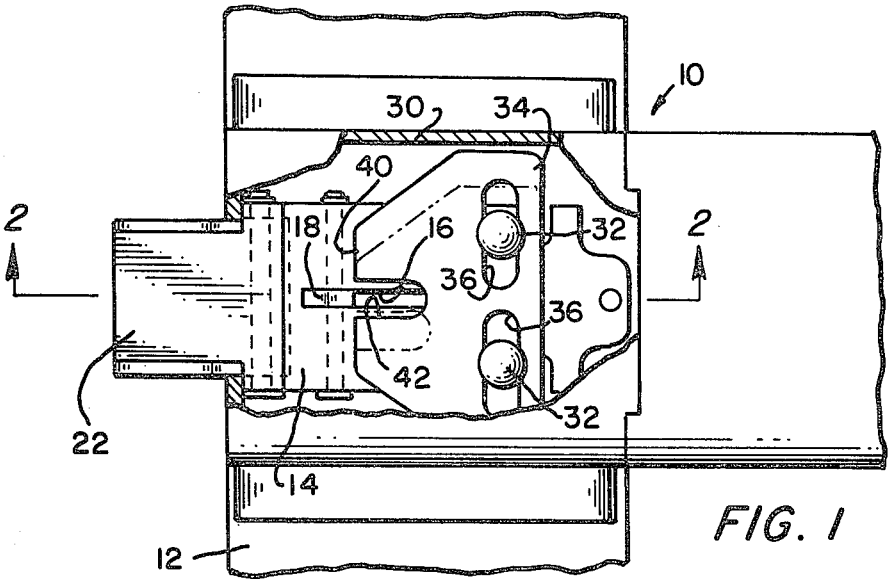
FIG. 1 is a plan view of a latching and unlatching device, according to the invention, in which a portion of the cover is cut away for purposes of clarity.
Figure 2:
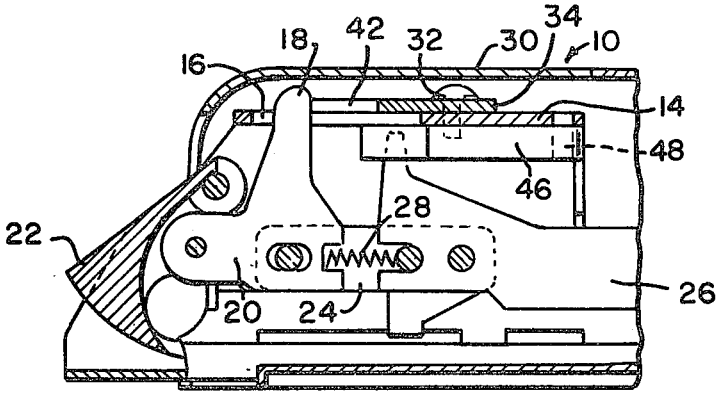
FIG. 2 is a cross-sectional view taken along section 2—2 of FIG. 1.

As shown in the figures, an embodiment 10 of the novel device comprises a base 12 to which is fixed (by hardware, not shown) a housing 14. The housing 14 has a top surface in which there is formed a guide slot 16. A projecting portion or limb 18 of a latch bolt link 20 is slidably received therein. The bolt link 20 pivotably receives a latch bolt 22, at one end, and is coupled, at the other end, by means of a control link clevis 24 to a control link 26. A spring 28 disposed between the latch bolt link 20 and the control link 26 biases the latch bolt 22 forwardly. A forward cover 30 encloses the aforementioned structure.

What has been described thus far is a rather conventional, off-the-shelf type of latching and unlatching device. It is operative, in at least one mode, by the translation of the control link 26. Now, this may be effected by a panic or push bar, or the like, according to prior art arrangements; in U.S. Pat. No. 3,614,145, issued to George Z. Zawadzki, for a "Dogging Device for Panic Exit Latch and Actuator Assembly" is an exemplary disclosure of such. Now, this otherwise conventional latching and unlatching device has been modified to incorporate the invention.

The housing 14 has a pair of bolt holes formed therein to receive standoff bolts 32. The latter secures, in loose, sliding fashion, a blocking plate 34. The plate 34 has a pair of elongated slots 36 in which to slidably accommodate the shanks of the bolts 32 in order that the plate 34 would be able to slide from side to side, if the cover 30 did not prevent this. The plate 34, however, has a width which substantially corresponds to the width across the inside cove 38 of the cover 30 and, consequently, is held in its intermediate slidable position. The plate 34 has a lateral edge 40 forwardly thereof which is interrupted by a relief 42 in which to accommodate the limb 18 when the latch bolt 22 is retracted (i.e., unlatched). Clearly, if the blocking plate 34 should slide in either direction from center, the lateral edge 40 will prevent the retraction of the limb 18 and, consequently, prevent unlatching of the device 10.

Figure 3:
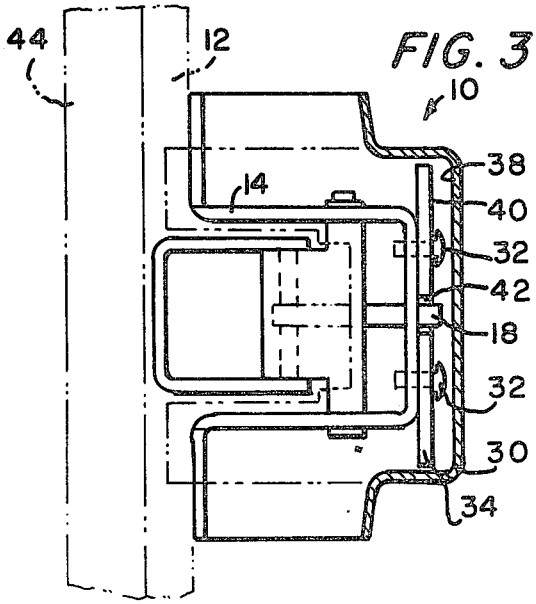
FIG. 3 is a front view, taken from the left side of FIG. 1, showing the cover in place and the blocking plate centrally disposed.

FIG. 3 shows the device 10 as it would be mounted, vertically, on a door 44, or the like; it will be appreciated that the forward cover defined cove 38 intimately nests the blocking plate 34. Accordingly, the blocking plate 34 is prevented from sliding downwardly.

Figure 4:
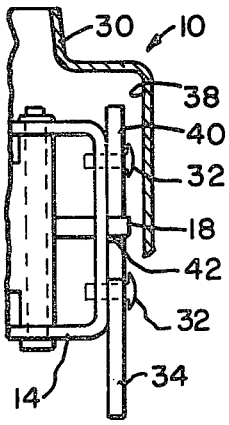
FIG. 4 is a fragmentary front view, similar to that of FIG. 3, in which a portion of the cover has disintegrated, i.e., melted away, due to heat, and consequently the blocking plate has moved to a position in which it prevents unlatching of the device.

The housing 14 and the base 12 are formed of steel, and the plate 34 is made of aluminum, whereas the cover 30 is formed of zinc. The latter has a relatively low melting point and, in the presence of excessive heat, will disintegrate. Such an occurrence is depicted in FIG. 4, where a portion of the cover 30 is represented as having melted away. In that the lower portion of the cove has disintegrated, i.e., melted, the plate 34 freely slid downwardly, and disposed the lateral edge 40 obstructively in immediate adjacency in the limb 18. Therefore, the limb 18 cannot retract, the latch bolt 22 remains extended, or latched, and the door 44 can not be opened.

As can be appreciated, all that is necessary, to modify an off-the-shelf, or typical latching and unlatching device to practice the invention, is as follows. A blocking plate 34, such as is shown, has to be slidably fixed to the top of the housing 14 with a relief 42 axially centered to accommodate the limb 18. Thereafter, it is necessary only to fix a zinc cover 30, or a similar cover, formed of material with a low melting point, thereupon to fix the plate 34 centrally on the housing. A kit for modifying such a device 10, therefore, comprises such a cover 30, a blocking plate 34, and the bolts 32 (or similar hardware) to secure the plate 34 to the top of the housing.

While I have described my invention in connection with specific embodiments thereof, it is to be clearly understood that this is done only by way of example, and not as a limitation to the scope of my invention as set forth in the objects thereof, and in the appended claims. For instance, a plate, such as plate 34, could be pivotably fixed to the housing 14, for slue in either direction. The device 10 has a gravity dog 46 which is pivotably pinned to the housing by a stub 48. Now, the gravity dog, and its purpose have no pertinence to the instant invention. However, in another embodiment, the stub 48 could be supplanted by an alternative stub having a portion projecting above the housing. A blocking plate could be pivotably mounted to the projecting portion of the stub; thus, the stand-off bolts 32 and the tapped holes therefor, as well as the slots 36 in the plate, could be omitted. Such a blocking plate would be of a different conformation. Its lateral edge, for obstructing the limb 18, would define an arc generally drawn from the pivot stub, albeit having increasing radii outwardly thereof. Also, in lieu of using a disintegratable cover 30, the aforesaid, alternative, pivotable blocking plate could be fixed to the housing 14, in its non-obstructive median positioning, by a bit of solder, or the like. If the device 10 does not have the gravity dog 46, then it is only necessary to provide a pivot pin (to serve the purpose of the extended stub—to pivotably mount the blocking plate). These, and further alternative embodiments of the invention as will occur to others, proceed from my teachings herein, and are deemed to be within the ambit of my invention and comprised by the following claims.

I claim:

1. Thermally-responsive means for preventing unlatching of a latching and unlatching device for a door, bulkhead, latch or the like, in combination with such a device having a base, and latch means, coupled to said base and movable, relative to said base, along a pathway between a first, latching position, and a second, unlatching position, wherein said thermally-responsive means comprises:

a plate, slidably coupled to said base, in adjacency to said latch means, for free, slidable movement thereof, in first and second opposite directions, (a) gravitationally and obstructively into traverse of said pathway, for preventing movement of said latch means fully along said pathway, and (b) counter-gravitationally out of traverse of said pathway, for permitting movement of said latch means fully along said pathway; wherein said plate has side edges on opposite sides thereof; and retainer means, coupled to said base, (a) having surfaces which obstruct said side edges and, consequently, prevent movement of said plate, in either of said first and second opposite directions, into traverse of said pathway and, responsive to exposure of said retainer means to a given temperature, (b) for releasing said, plate whereby the latter is free to move gravitationally and obstructively, as aforesaid, into traverse of said pathway.

2. Thermally-responsive means, according to claim 1, wherein:

said retainer means comprises means which, in response to exposure thereof to said given temperature, disintegrates.

3. Thermally-responsive means, according to claim 1, wherein:

said retainer means is formed of a material having a relatively low melting point temperature.

4. Thermally-responsive means, according to claim 1, wherein:

said retainer means is formed of a material having a given melting point temperature; and said base and latch means of said device, and said plate are formed of a material having a melting point temperature which is higher than said given temperature.

5. Thermally-responsive means for preventing unlatching of a latching and unlatching device for a door, bulkhead, latch or the like, in combination with such a device having a base, and latch means, coupled to said base and movable, relative to said base, along a pathway between a first, latching position, and a second, unlatching position, wherein said thermally-responsive means comprises:

blocking means, coupled to said base, in adjacency to said latch means, for free movement thereof (a) gravitationally and obstructively into traverse of said pathway, for preventing movement of said latch means fully along said pathway, and (b) counter-gravitationally out of traverse of said pathway, for permitting movement of said latch means fully along said pathway; and retainer means, coupled to said base, (a) holding said blocking means out of traverse of said pathway and, responsive to exposure of said retainer means to a given temperature, (b) for releasing said blocking means, whereby the latter is free to move gravitationally and obstructively, as aforesaid, into traverse of said pathway; wherein said retainer means comprises an external cover for said latching and unlatching device.

6. Thermally-responsive means, according to claim 5, wherein:

said latch means is movable along a given longitudinal axis;

said blocking means is slidably coupled to said base for movement thereof in traverse of said axis.

7. Thermally-responsive means for preventing unlatching of a latching and unlatching device for a door, bulkhead, latch or the like, in combination with such a device having a base, and latch means, coupled to said base and movable, relative to said base, along a pathway between a first, latching position, and a second, unlatching position, wherein said thermally-responsive means comprises:

blocking means, coupled to said base, in adjacency to said latch means, for free movement thereof (a) gravitationally and obstructively into traverse of said pathway, for preventing movement of said latch means fully along said pathway, and (b) counter-gravitationally out of traverse of said pathway, for permitting movement of said latch means fully along said pathway; and retainer means, coupled to said base, (a) holding said blocking means out of traverse of said pathway and, responsive to exposure of said retainer means to a given temperature, (b) for releasing said blocking means, whereby the latter is free to move gravitationally and obstructively, as aforesaid, into traverse of said pathway; wherein said base comprises a platform and a housing coupled to said platform;

said housing has a guide track formed therein;

said latch means includes a limb slidably engaged with said track, and movable therealong;

said blocking means comprises a plate slidably fastened to said housing in immediate adjacency to said track;

said plate has a lateral edge which, upon said plate sliding into any one of a plurality of given dispositions traverses said track;

said lateral edge has, normal thereto, a longitudinal relief formed therein which, upon said plate sliding into a disposition other than said given dispositions, colinearly aligns with said track;

said limb has a portion thereof which penetrates said track and is movable through said relief, upon said plate being in said other disposition;

said limb is juxtapositioned with said lateral edge, and is prevented, by said edge, from movement along said track, upon said plate being in said any one of said plurality of given dispositions;

said retainer means comprises a cover;

said cover has a cove formed therein of a given transverse dimension;

said plate is slidable along an axis, and has an axial dimension substantially corresponding to said given transverse dimension;

said cover is closed upon said plate; and said plate is nested in said cover and held, therely, in said other disposition.

8. A method of modifying a latching and unlatching device for a door, bulkhead, latch or the like, to prevent the device from being unlatchable in the presence of a given temperature, wherein such device has a base, and latch means, coupled to said base and movable, relative to said base, along a pathway between a first, latching position, and a second, unlatching position, wherein said modifying method comprises the steps of:

coupling a plate, which has side edges on opposite sides thereof, to said base, in adjacency to said latch means, for free slidable movement thereof, in first and second opposite directions, (a) gravitationally and obstructively into traverse of said pathway, to prevent movement of said latch means fully along said pathway, and (b) counter-gravitationally out of traverse of said pathway, to permit movement of said latch means fully along said pathway; and coupling a thermally-sensitive retainer to said base, with surfaces of said retainer obstructing said side edges of said plate, consequently to prevent movement of said plate in either of said first and second directions into traverse of said pathway, which retainer is thermally-sensitive, as aforesaid, and is responsive to exposure thereof to said given temperature to release said plate, whereby the latter is free to slide gravitationally and obstructively, as aforesaid, into traverse of said pathway.

9. A method, according to claim 8, wherein said retainer coupling step comprises coupling to said base a retainer which, in response to exposure thereof to said given temperature, disintegrates.

10. A kit for modifying a latching and unlatching device for a door, bulkhead, latch or the like, to prevent the device from being unlatchable in the presence of a given temperature, wherein such device has a base, and latch means, coupled to said base and movable, relative to said base, along a pathway between a first latching position, and a second, unlatching position, said modifying kit comprising:

a plate, having a prescribed width defined by first and second side edges thereof for coupling thereof to said base, in adjacency to said latch means, for free slidable movement thereof in first and second, side-to-side, opposite directions (a) gravitationally and obstructively into traverse of said pathway, for preventing movement of said latch means fully along said pathway, and (b) counter-gravitationally out of traverse of said pathway, for permitting movement of said latch means fully along said pathway; and a thermally-sensitive retainer, for coupling thereof to said base, having substantially parallel side surfaces spaced apart by a distance which is substantially the dimension of said prescribed width for coupling said retainer to said base, as aforesaid, with said side surfaces set, astride said plate, in obstruction of said side edges for holding said plate out of traverse of said pathway;

said retainer being thermally-sensitive, as aforesaid, and comprising means responsive to an exposure thereof to said given temperature, for releasing said plate, whereby the latter, upon having been coupled to said base, will be free to slide gravitationally and obstructively, as aforesaid, into traverse of said pathway.

11. A kit, according to claim 10, wherein:

said retainer comprises means which, in response to exposure thereof to said given temperature, causes said retainer to disintegrate.

* * * * *